US005897021A

United States Patent [19]

Babcock

[11] Patent Number: 5,897,021

[45] Date of Patent: Apr. 27, 1999

[54] BUCKET

[76] Inventor: David W. Babcock, 4424 Ridgeway, Kansas City, Mo. 64133

[21] Appl. No.: 08/787,689

[22] Filed: Jan. 23, 1997

[51] Int. Cl.[6] ..... B65D 25/32

[52] U.S. Cl. ..... 220/772; 220/756; 220/776

[58] Field of Search ..... 220/752, 756, 220/760, 765, 772, 773, 776, 774, 775, 769, 770

[56] References Cited

U.S. PATENT DOCUMENTS

| | | | |
|---|---|---|---|
| 552,390 | 12/1895 | Painter | 220/772 X |
| 694,807 | 3/1902 | Vanderburg | 220/772 X |
| 1,948,202 | 2/1934 | Chapman | 220/772 X |
| 1,987,492 | 1/1935 | Reynolds | 220/772 X |
| 3,503,644 | 3/1970 | Johnson . | |
| 3,811,605 | 5/1974 | Flider . | |
| 4,491,251 | 1/1985 | Pratz et al. . | |
| 4,881,650 | 11/1989 | Bartz . | |
| 4,896,913 | 1/1990 | Kennedy . | |
| 4,969,571 | 11/1990 | Bartz . | |
| 5,307,951 | 5/1994 | Kuhn . | |
| 5,392,957 | 2/1995 | Parsons . | |
| 5,482,339 | 1/1996 | Chishko, Jr. . | |

*Primary Examiner*—Stephen Castellano
*Assistant Examiner*—Niki M. Eloshway
*Attorney, Agent, or Firm*—Chase & Yakimo, L.C.

[57] ABSTRACT

A container for one-handed transport and pouring of contents therefrom includes a vessel having an outlet with first and second handle assemblies pivotally mounted to the sides of the vessel. A first handle assembly includes a wire band having first and second ends pivotally mounted to opposed sides of the vessel at points forward of an imaginary vertical plane bisecting the vessel. An offset portion of the handle presents a grip displaced from the arcuate extent of the band. A second handle assembly includes a wire band having first and second ends pivotally mounted to opposed sides of the vessel and along the imaginary vertical plane. The band presents first and second loops about the legs of the offset portion of the first handle with the grip extending therebetween. In the normal transport position the grips of the handle are displaced one from the other. Upon a user urging of the grips one towards the other, as guided by the loops encircling the legs of the offset portion, the vessel is pivoted about the pivot mounting points so as to dispense the contents from the vessel. The handle assemblies are adaptable for use with various containers.

11 Claims, 6 Drawing Sheets

BUCKET

BACKGROUND OF THE INVENTION

This invention relates to a bucket and, more particularly, to an improved bucket/container designed for one-handed transport and manipulation.

The common bucket is well known in the art for transporting materials, particularly fluids, between locations. One problem with past buckets is that the dispensation of the materials therefrom is awkward and in some cases difficult particularly if the user cannot use both hands for manipulation of the bucket at the dispensation site.

In response thereto I have invented an improved container, which can take the form of a bucket or other vessel, having first and second handle assemblies thereon. Each handle assembly is pivotally mounted to opposed sides of the bucket, the handles presenting spaced-apart central grips. The pivot mounting points of each handle assembly are spaced apart in relative vertical and horizontal displacements. For transport of the bucket the grip of the second handle assembly is grasped. For pouring the contents from the bucket both first and second grips are grasped and urged one towards the other. Upon such grip movement the bucket is pivoted around the pivotal mounting points of the handle assemblies such as to move the bucket between a first transport position and a second position for dispensing the material contents therefrom. Accordingly, only one hand need be used for transport and manipulation of the bucket. The handle design is adaptable for use with various vessels, containers and the like.

It is therefore a general object of this invention to provide a container designed for one-handed transport and dispensation of contents therefrom.

A still further object of this invention is to provide container, as aforesaid, which is adaptable for use in various forms, including buckets, paint material containers, vessels and the like.

A further object of this invention is to provide a container, as aforesaid, presenting first and second handle assemblies, each assembly having spaced-apart pivot points mounted on the opposed sides of the container.

Another object of this invention is to provide a container, as aforesaid, wherein the first and second handle assemblies present central grips displaced one from the other in a container transport position.

Still a further object of this invention is to provide a container, as aforesaid, having structure coupling the grips of the handles in back and forth movement therebetween.

Another object of this invention is to provide a container, as aforesaid, the first and second grips being urged one towards the other so as to pivot the bucket from a first transport position towards a second position for dispensing the contents therefrom.

A further object of this invention is to provide handle assemblies, as aforesaid, which are adaptable for use with various containers.

Other objects and advantages of this invention will become apparent from the following description taken in connection with the accompanying drawings, wherein is set forth by way of illustration and example, a preferred embodiment of this invention.

DESCRIPTION OF THE PREFERRED EMBODIMENT

DESCRIPTION OF THE PREFERRED EMBODIMENT

Figure 1:
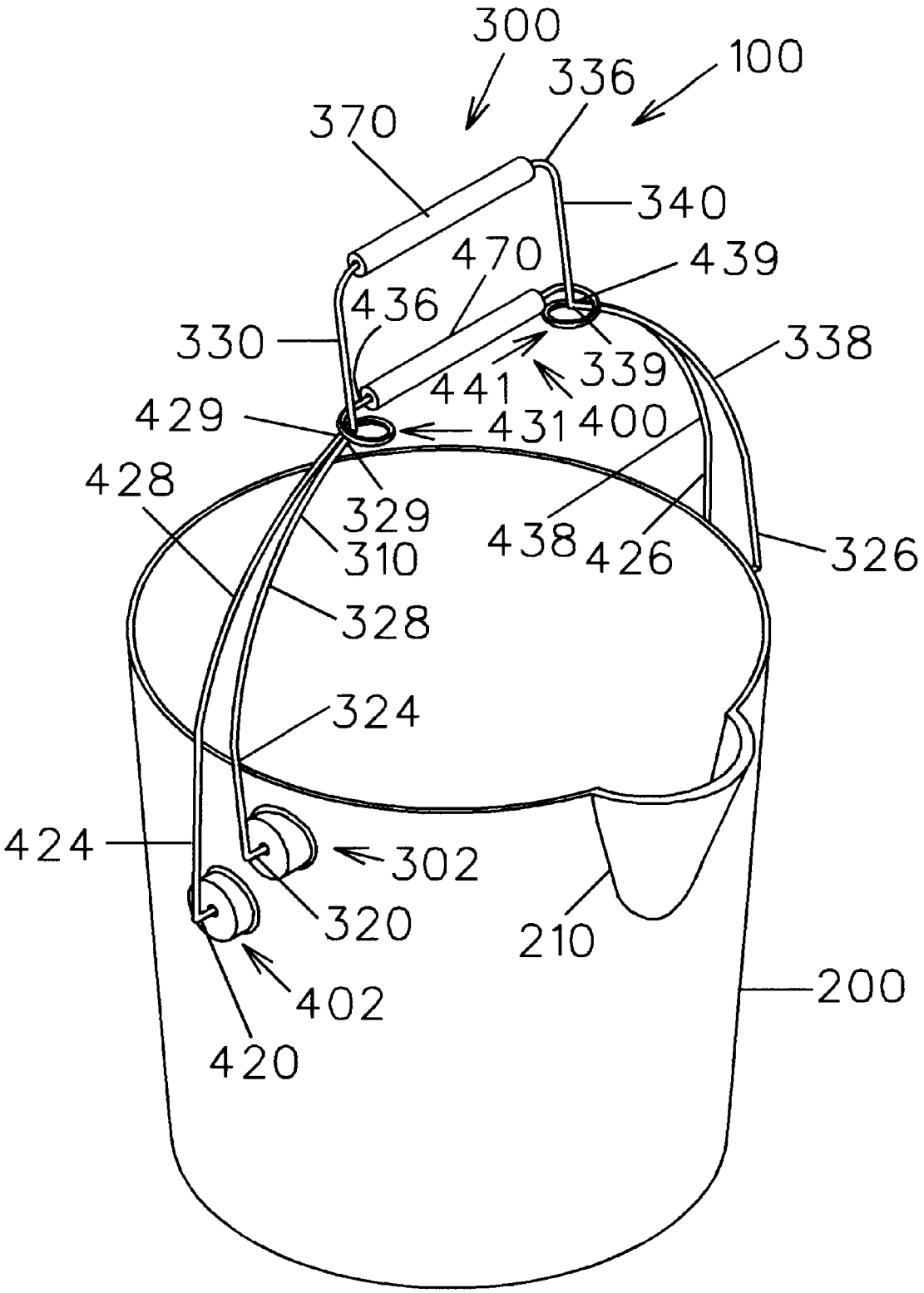
FIG. 1 is a perspective view of the improved container in the form of a bucket at a transport position.
Figure 2:
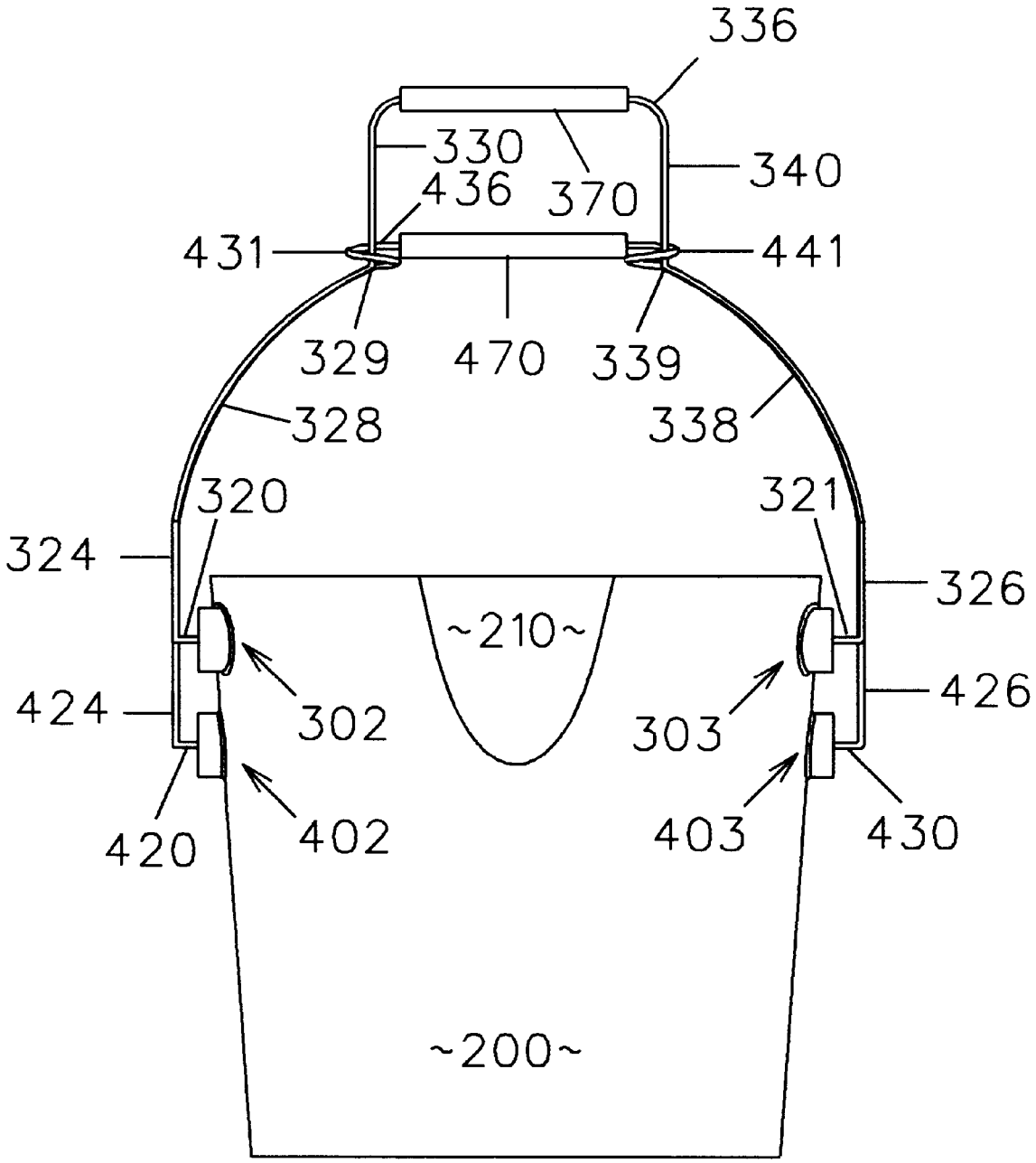
FIG. 2 is a front view of the bucket of FIG. 1.
Figure 3:
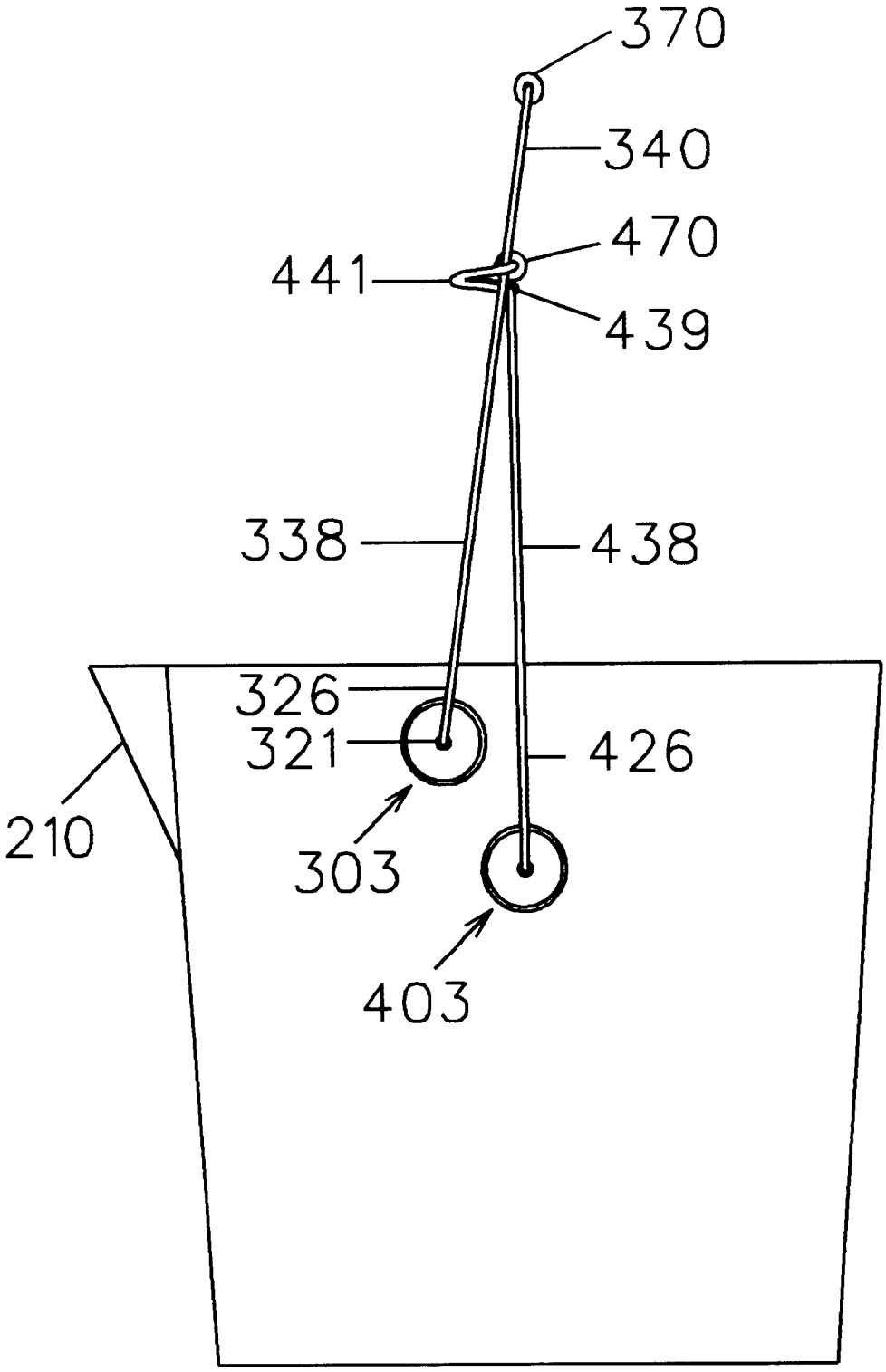
FIG. 3 is a side view of the bucket of FIG. 1.
Figure 4:
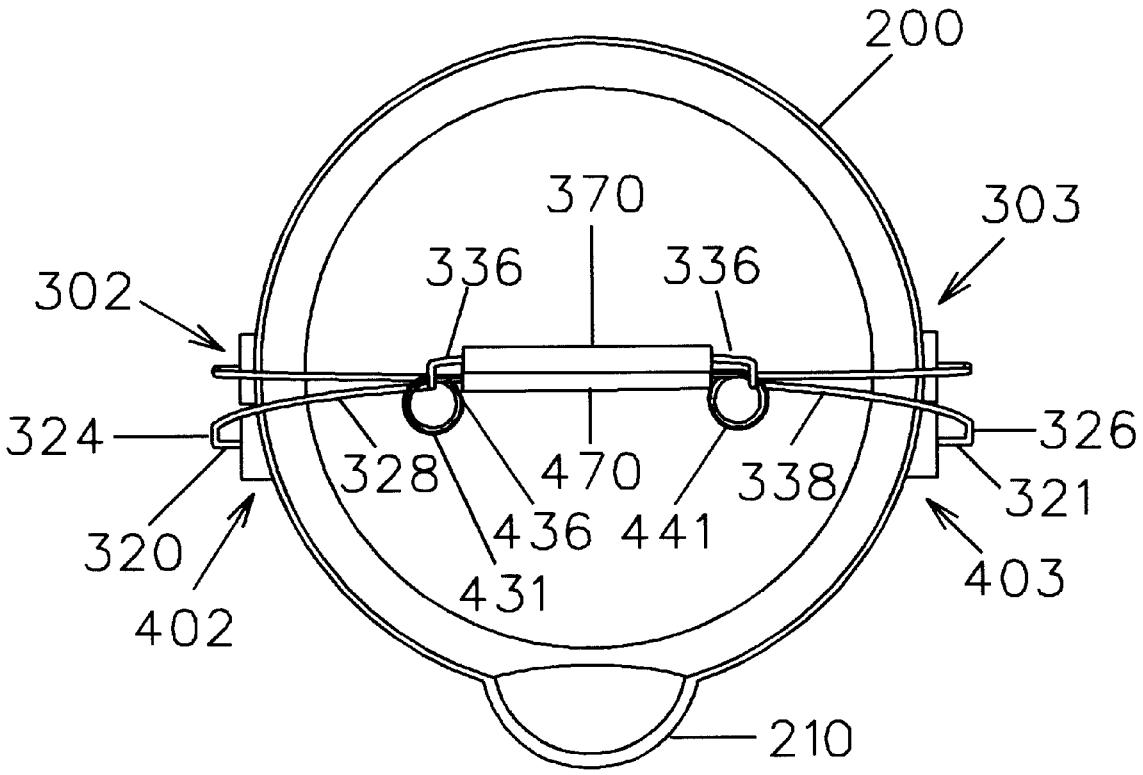
FIG. 4 is a top view of the bucket of FIG. 1.

Turning more particularly to the drawings, FIG. 1 shows the improved container in the form of a bucket 100 comprising a vessel 200 with spout 210, a first handle assembly 300 and a second handle assembly 400.

The vessel 200 may take the form of various containers with or without the spout 210, it being understood that the principles of my invention disclosed herein are adaptable for use with variously configured vessels.

The first handle assembly 300 comprises a configured wire band 310 having first 320 and second 321 laterally spaced-apart end portions. Each end portion 320, 321 is pivotally mounted at its respective terminus to opposed sides of the vessel 200. The mounting points are preferably forward of a vertical plane which symmetrically bisects the vessel 200 and includes the vertical central axis of the vessel. Each wire end 320, 321 extends into a housing 302, 303 located on opposed sides of the vessel 200 such that the wire ends 320, 321 are free to rotate therein. Of course, it is understood that other ways may be used to mount the ends 320, 321 to the walls of the vessel 200 so as to allow for rotation of the vessel 200 about such ends 320, 321.

As shown in FIG. 1, the wire band 310 then upwardly extends from each end portion 320, 321 so as to present straight course portions 324, 326. A pair of arcuate course portions 328, 338 extend from an end of each straight course portion 324, 326 and one towards the other. At the terminus 329, 339 of each arcuate course 328, 338 an offset occurs such that the band presents straight courses or legs 330, 340. Normally extending between legs 330, 340 is a straight course 336 presenting a user grip 336. A cushioning sleeve 370 may encompass this grip 336.

A second handle assembly 400 presents a wire band having end portions 420, 430 pivotally mounted to the opposed side walls of the vessel 200 in a manner similar to wire ends 320, 321 as above described. These pivot points 402, 403 are preferably aligned with the above described vertical bisector plane which includes the central vertical axis of the vessel 200, these pivot points 402, 403 being displaced below pivot points 302, 303. Upwardly extending from the end portions 420, 430 are straight course portions 424, 426 with arcuate portions 428, 438 extending therefrom. At the terminus 429, 439 of these arcuate portions 428, 438 wire band loops 431, 441 are wound about the legs 330, 340 of the offset of the first handle assembly 300. A straight course 436 then extends between the legs 330, 340 so as to present a second grip 436 which may be surrounded by a cushioning sleeve 470. The loops 431, 441 couple the grip 436 of the handle assembly 400 to the legs 330, 340 of the offset of the handle assembly 300. As such, a constrained back and forth movement of the grips 336, 436 is defined by the loop 431, 441/leg 330, 340 interface.

Accordingly, as shown in FIG. 1, the handle assemblies 300, 400 present first and second handle grips 336, 436 displaced one from the other when the bucket is in its normal FIG. 1 transport position.

Figure 5:
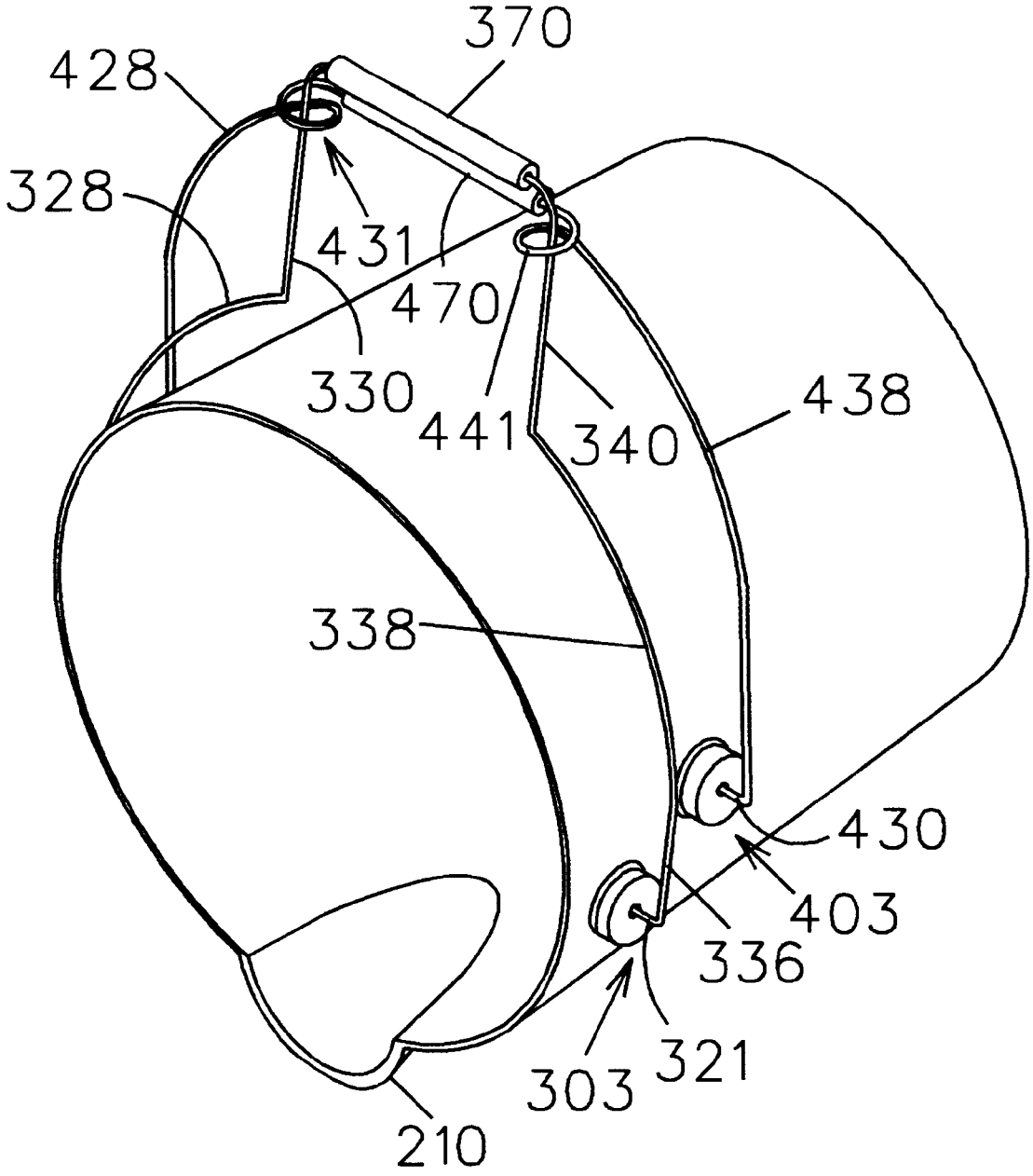
FIG. 5 is a perspective view of the bucket of FIG. 3 shown in a second position for dispensation of material therefrom.
Figure 6:
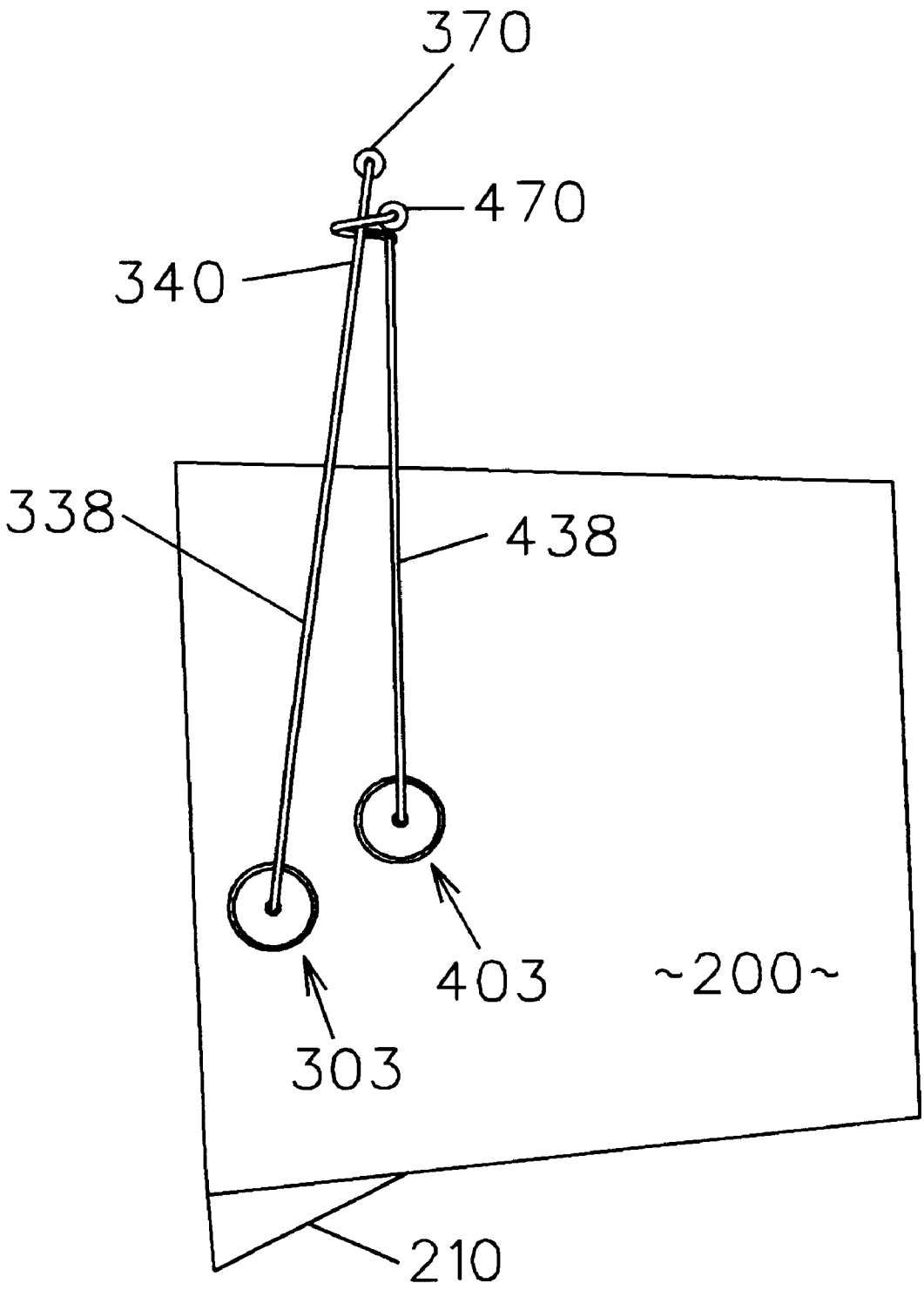
FIG. 6 is a side view of the bucket of FIG. 5.

In use to transport the bucket 100 between locations, the user grasps the lower grip 436. Upon a desire to dispense the contents of the vessel 200, the user urges the lower grip 436 towards the upper grip 336, the movement therebetween being guided by the loops 431, 441 surrounding the legs 330, 340 of handle assembly 300. The movement of grips 336, 436 one towards the other causes the bucket to swing about the pivot points 302, 303, 402, 403 such that the vessel 200 swings from the FIG. 1 transport position to the FIG. 5 pouring position.

It is understood that the initial displacement between the grips 336, 436 will govern the degree of pivotal movement of the vessel 200. It is understood that the figures show the limits of the pivotal movement and that the movement of the vessel may cease between these two limits upon the user stopping the movement of the grips 336, 436 one towards the other. Upon releasing grip 436 the weight of the vessel 200 will cause the vessel 200 and grips to return to their FIG. 1 transport position.

Accordingly, it can be seen that the above handle assemblies 300, 400 allow for one-handed transport and pouring of the contents from the vessel 200.

It is to be understood that while a now preferred form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A container comprising:

a vessel having an outlet at a top edge thereof;

a first handle assembly including a band having first and second ends, each band end pivotally mounted to pivot points on opposed sides of said vessel, said pivot points below said top vessel edge and forward of an imaginary vertical plane bisecting said vessel when said vessel is in a transport position, said first handle assembly presenting a grip for a user;

a second handle assembly including a band having first and second ends, each band end of said second handle assembly pivotally mounted to pivot points on opposed sides of said vessel, said pivot points of said second handle assembly at locations on said vessel displaced below said pivot points of said band ends of said first handle assembly and aligned with said vertical plane, said pivotally mounted second handle assembly presenting a grip displaced a selected distance from said pivotally mounted grip of said first handle assembly during said transport position of said container, said pivotally mounted first and second handle assemblies adapted for a user-regulated one-handed movement of said respective grips of said assemblies between a first normally spaced-apart transport position wherein said vessel is at said transport position and a second grip adjacent position wherein said outlet of said vessel is at a discharge position, said distance between said displaced grips at said first transport position cooperating with said displaced pivot points of said displaced grips to rotate said vertical plane from said vertical position to at least a horizontal position above said pivot points of said first handle assembly and move said outlet to said discharge position below said pivot points of said first handle assembly upon said user movement of said grips from said first to said second grip position wherein said vessel is pivoted about said pivot points of said respective handle assemblies between the transport position and a position wherein said outlet is positioned for a generally full pouring of contents from said vessel.

2. The container as claimed in claim 1 wherein said grip of said first handle comprises a portion offset from said band, said offset portion presenting first and second legs extending from said band and a strut extending therebetween.

3. The container as claimed in claim 2 wherein said grip of said second handle assembly extends between said first and second legs and further comprises coupling means for connecting said band of said second handle assembly to said first and second legs of said first handle in back and forth movement therealong.

4. The container as claimed in claim 1 wherein said bands generally vertically extend from said pivot points on said vessel and beyond said top vessel edge at said transport position, said bands remaining at said same extension during said user movement of said grips between said first and second grip positions.

5. A container comprising:

a vessel having a rim encompassing an opening at a top thereof for dispensing contents from said opening;

a first handle including a band having first and second ends pivotally mounted at pivot points on said vessel below said rim and forward of an imaginary vertical plane bisecting said vessel when said vessel is in a first transport position for maintaining the contents therein, said first handle presenting a grip for user transport of said vessel, said vessel pivotable about said pivot points of said first handle ends between said first position maintaining the contents in said vessel and a second position dispensing the contents from said vessel from said opening;

a second handle including a band having first and second ends pivotally mounted at pivot points on said vessel located at a distance below said pivot points of said first handle, said second handle pivot points aligned with said vertical plane, said pivotally mounted second handle presenting a grip displaced below said grip of said first handle in said first vessel position, said grip displacement cooperating with said displaced mounting of said handle ends to said pivot points, wherein said vertical plane is at least rotated to a horizontal position above said pivot points and ends of said first handle with said rim positioned in a vertical relationship relative to said horizontal plane at said second vessel position upon a user movement of said grips to a position contacting one another;

link means on said second handle for connecting said second handle grip with said first handle grip in back and forth movement therebetween, a user movement of said spaced-apart grips one towards the other pivoting said vessel about said ends of said first handle mounted to said pivot points between said first and second vessel positions.

6. The container as claimed in claim 5 wherein said link means comprises first and second spaced-apart loops on said second handle and encompassing portions of said first handle for defining a course of relative movement between said grips.

7. The container as claimed in claim 6 wherein a pivotal movement of said vessel from said second position towards said first position displaces said grips one from the other.

8. The container as claimed in claim 5 wherein said first handle comprises:

an offset structure which displaces said first handle grip from said band at said first vessel position.

9. The container as claimed in claim 8 wherein said link means connects said second handle grip to said offset portion in back and forth movement relative to said first handle grip.

10. The container as claimed in claim 9 wherein said second handle comprises:

at least one loop between said second handle grip and said band of said second handle, for encircling a portion of said offset structure of said first handle, said loop connecting said second handle grip to said first handle grip and allowing relative movement therebetween.

11. The container as claimed in claim 5 wherein said handles generally vertically extend from said vessel and beyond said top at said transport position, said handles remaining at said same extension during said movement of said grips contacting one another.

* * * * *